United States Patent [19]

Stevenson

[11] Patent Number: 4,672,712

[45] Date of Patent: Jun. 16, 1987

[54] WIND RESTRAINING STAY ROLLER ASSEMBLY FOR SLIDING DOORS

[75] Inventor: Ralph G. Stevenson, Elma, Iowa

[73] Assignee: Lynn B. Stevenson, Elma, Iowa

[21] Appl. No.: 812,903

[22] Filed: Dec. 23, 1985

[51] Int. Cl.[4] ..... E05D 15/06

[52] U.S. Cl. ..... 16/91

[58] Field of Search ..... 16/89, 90, 91; 49/410, 49/411; 312/138 R

[56] References Cited

U.S. PATENT DOCUMENTS

| | | | |
|---|---|---|---|
| 307,131 | 10/1884 | Mattoon | 16/91 |
| 350,751 | 10/1886 | Lane | 16/91 |
| 873,816 | 12/1907 | Wideman | 16/91 |
| 988,880 | 4/1911 | Klotz | 16/91 |

*Primary Examiner*—Fred Silverberg

*Attorney, Agent, or Firm*—Zarley, McKee, Thomte, Voorhees & Sease

[57] ABSTRACT

The device of the present invention is used in combination with a building having a door opening and at least one slidable door with upper and lower edges and opposite front and back sides for restraining the door against forward and backward movement with respect to the door opening. The door is supported at its upper edge by a guide track so as to be laterally movable between an open position and a closed position. The device includes an elongated bar extending across the door opening and having opposite ends, end brackets for releasably securing the opposite ends of the bar to the sides of the door opening, and a plurality of rollers each of which are operatively connected to the elongated bar by a support bracket, and being rotatable about a vertical axis. The elongated bar, support brackets and rollers form an elongated channel for receiving the lower edge of the door and for preventing forward and rearward movement of the door with respect to the door opening. The space between the rollers and the elongated bar is adjustable such that the device can accommodate doors having varying thicknesses. A quick-release pin permits the bar, support brackets and rollers to be quickly and easily removed from the end brackets.

13 Claims, 5 Drawing Figures

WIND RESTRAINING STAY ROLLER ASSEMBLY FOR SLIDING DOORS

BACKGROUND OF THE INVENTION

Storage buildings, such as Morton Sheds, are typically provided with at least one large sliding door which is supported at its upper edge by a guide track for sliding or lateral movement between an open and closed position with respect to the door opening of the building. When such a sliding door is closed, there is a tendency for wind to catch the large surface area of the door and cause the lower edge of the door to move forwardly or rearwardly with respect to the door opening, since the door is supported only at its upper edge. Such swinging movement of the door can cause damage thereto, as well as allow rain and snow and other elements of nature to be blown into the building.

Accordingly, it is a primary objective of the present invention to provide a device for restraining forward and rearward movement of a sliding door with respect to the door opening covered by the door.

A further objective of the present invention is the provision of a doorkeeper device for restraining movement of a closed sliding door which can be quickly installed and removed from its position within the door opening.

Another objective of the present invention is the provision of a device for limiting the forward and rearward movement of a sliding door with respect to a door opening which can accommodate doors of varying thicknesses.

Still a further objective of the present invention is the provision of a device for restraining the movement of a sliding door caused by wind that is easy to install, durable in use, and economical to manufacture.

These and other objectives will become apparent from the following description of the present invention.

SUMMARY OF THE INVENTION

The present invention concerns a device for restraining forward and rearward movement of a sliding door with respect to a door opening when the door is closed. Generally, the device comprises an elongated channel extending across the door opening for receiving the lower edge of the door which is suspended at its opposite upper edge by a guide track for lateral movement therealong. More particularly, the device includes an elongated bar having opposite ends which are releasably secured to the opposite sides of the door opening by a securing bracket. Each securing bracket includes a plate attached to the sides of the door frame, which defines the door opening, adjacent the ground or floor of the building. Each securing bracket further includes a pair of spaced apart legs and an interconnecting web which form a U-shaped channel having an open end for receiving the respective end of the elongated bar. A removable pin extends through a hole in each leg of the U-shaped channel and locks the respective end of the bar in position within the U-shaped channel.

The device further includes a plurality of rollers spaced forwardly from the bar, each of which are mounted upon a support bracket for rotation about a vertical axis. Each support bracket has a first portion secured to the bar, a second portion extending forwardly from the bar beneath and beyond the lower edge of the door, and an axle extending upwardly from the forward end of the second portion for rotatably supporting the roller. Thus, the bar, the second portion of the support bracket, and the roller define a channel for slidably receiving the lower edge of the door when the door is moved between the open and closed positions, such that the bar and the rollers limit the rearward and forward movement of the door, respectively. The roller supporting axle is mounted within a slot on the second portion of the support bracket such that the distance between the rollers and the bar can be adjusted, whereby the device can accommodate doors of varying thicknesses.

DETAILED DESCRIPTION OF THE DRAWINGS

Figure 1:
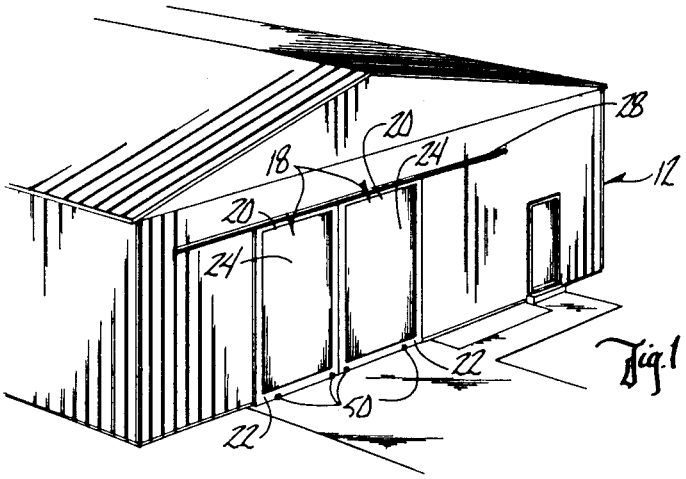
FIG. 1 is a perspective view of a storage building having a pair of sliding doors which slidably move between open and close positions with respect to a door opening.

The device of the present invention is generally designated by the reference numeral 10 in the drawings. Device 10 is generally used in combination with a building 12 having a door frame 14 which defines a door opening, and having at least one slidable door 18 having an upper edge 20, a lower edge 22, a front side 24, and a back side 26. While building 12 in FIG. 1 is shown to have two sliding doors 18, it is understood that device 10 can be utilized with a single door, as further described below, or with multiple sliding doors. Door 18 is supported at its upper edge by a guide track 28 secured to building 12 above the door opening such that door 18 is laterally movable along the guide track between an open position and a closed position with respect to the door opening.

Device 10 includes an elongated bar 30 extending across the door opening and having opposite ends 32 and 33 which are releasably secured to the opposite sides of door frame 14 by end brackets 34 and 35, respectively. Ends 32 and 33 of bar 30 are identical to one another, as are end brackets 35 and 35. Preferably, bar 30 is constructed of a 2"×2", 12 or 14 gauge metal tubing.

Each end bracket includes a plate 36 which is fastened to door frame 14 by lag screws 38 or the like. Each bracket 34, 35 further includes a pair of legs 40 interconnected by a web 42 so as to define a U-shaped collar 44 having an open end 46 for receiving the respective end 32, 33 of bar 30. Each leg 40 has an opening therethrough adapted to receive a pin 48 or the like which locks the ends of bar 30 in position within U-shaped collar 44 and which can be easily removed such that bar 30 can be easily removed from its position in the door opening. Only one of pins 48 need be removed such that the end of bar 30 can be slid out of open end 46 of U-shaped collar 44 with the opposite end of bar 30 being easily pulled out of the associated end bracket.

Figure 4:
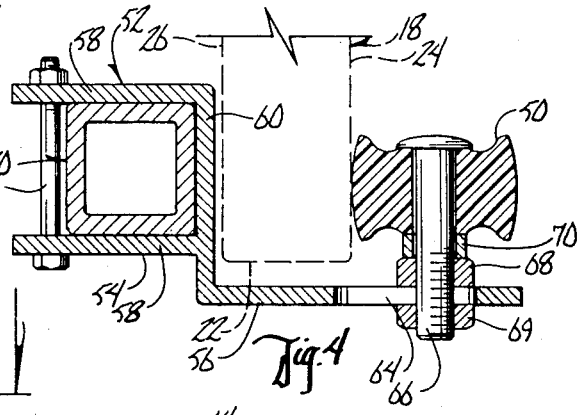
FIG. 4 is a sectional view taken along lines 4—4 of FIG. 3.
Figure 5:
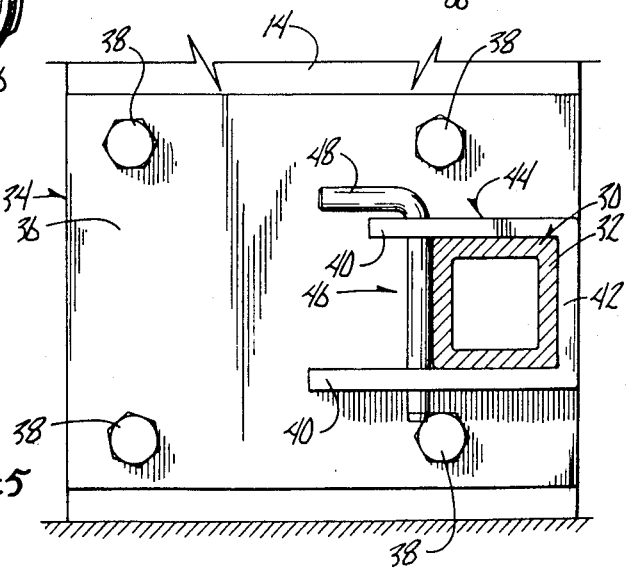
FIG. 5 is a sectional view taken along lines 5—5 of FIG. 2.

Device 10 further includes a plurality of rollers 50 which are rotatable about a vertical axis, each of which are spaced forwardly from bar 30 by means of a support bracket 52. Each support bracket 52 includes a first portion 54 which is secured to bar 30 and a second portion 56 extending forwardly from first portion 54 beneath and beyond lower edge 22 of door 18. As best seen in FIG. 4, first portion 54 of support bracket 52 has a pair of spaced apart legs 58 and an interconnecting web 60 which form a U-shaped collar that matingly engages the square tubing of bar 30, with a nut and bolt assembly 62 securing first portion 54 to bar 30. It is understood that first portion 54 of support bracket 52 may take other configurations and may be secured to bar 30 by any convenient means.

Second portion 56 of support bracket 52 is preferably a flat plate having an elongated slot 64 therein. A bolt 66 extends through slot 64 and is secured thereto by a pair of lock nuts 68, 69. Bolt 66 serves as an axle for roller 50 which is rotatably mounted thereon. A bushing 70 may be provided between roller 50 and the upper lock nut 68 to assure easy rotation of roller 50 upon bolt 66.

Figure 2:
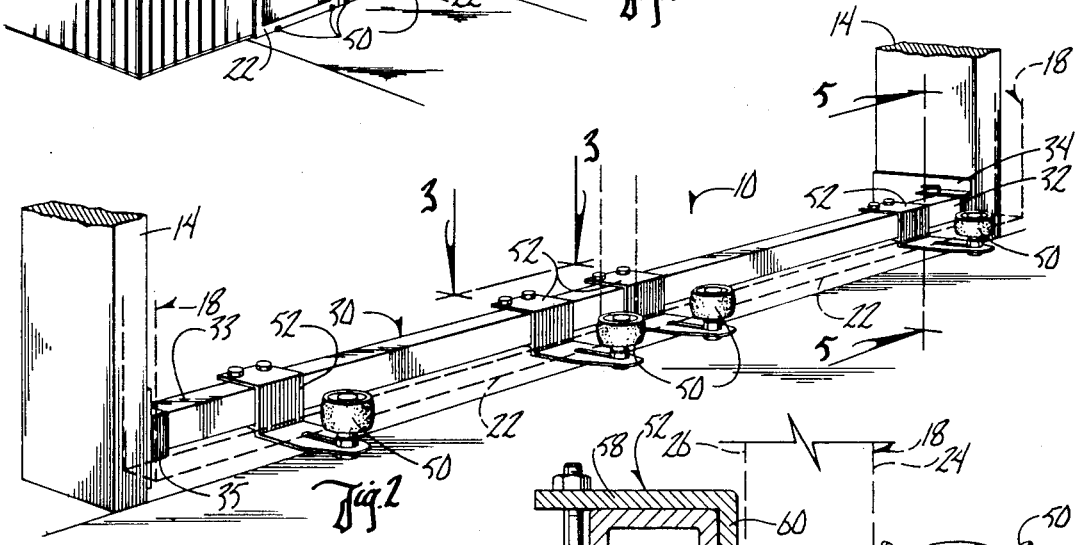
FIG. 2 is a perspective view of the device of the present invention mounted within the door frame defining the door opening of the building.
Figure 3:
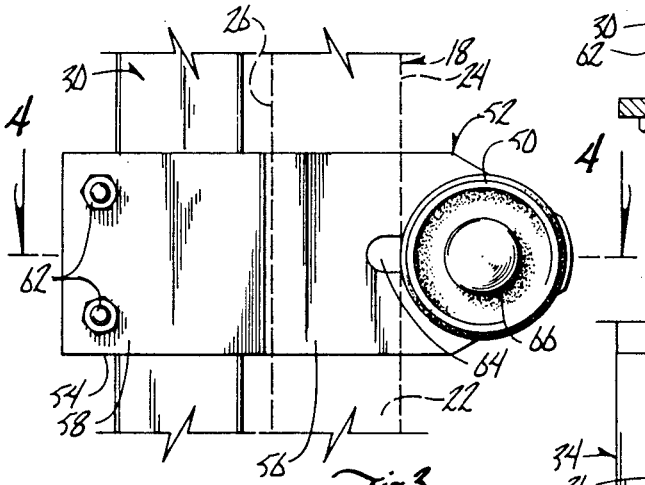
FIG. 3 is a partial top plan view of the device taken along lines 3—3 of FIG. 2.

As seen in FIGS. 2 and 4, bar 30, second portion 56 of support bracket 52, and roller 50 define an elongated channel for receiving the lower edge 22 of door 18. The elongated channel of device 10 does not inhibit the lateral movement of the sliding door with respect to the door opening when the door moves between the open and closed positions. Also, the channel of device 10 restrains any forward or rearward movement of the lower edge of the door when the door is closed. In the absence of device 10, wind can catch the large surface area of the door and swing it forwardly and rearwardly about its supported upper edge since the lower edge is otherwise unrestrained. Thus, device 10 prevents such swinging movement of the door and thereby minimizes damage to the door and prevents rain, snow and other elements of nature from being blown into building 12. When it is desired to move equipment such as a tractor or the like through the door opening, bar 30, along with the attached support bracket 52 and rollers 50, can be easily removed from the door frame 14 simply by removing one of pins 48 and sliding the associated end of bar 30 out of the open end 46 of U-shaped collar 44 and pulling the opposite end of bar 30 from the respective end bracket. The steps are easily reversed for replacing bar 30 with the attached support brackets 52 and rollers 50 in position in the door opening.

Accordingly, it is seen that the device of the present invention accomplishes at least all of its stated objectives.

What is claimed is:

1. In combination with a building having a floor, a door opening and at least one slidable door with upper and lower edges and opposite front and back sides, the door being supported at the upper edge by a guide track so as to be laterally movable along said guide track between an open position and a closed position with respect to the door opening, a device for restraining the closed door against forward and backward movement, said device comprising:

an elongated bar extending across said door opening and having opposite ends, said bar being above and adjacent to said floor;

securement means for releasably securing the opposite ends of said bar to the sides of the door opening;

restraining means attached to said bar and spaced forwardly therefrom so as to define a channel between said bar and said restraining means;

said lower edge of said door being received within said channel when said door is in the closed position whereby said bar prevents rearward movement of said door and said restraining means prevents forward movement of said door.

2. The device of claim 1 wherein said restraining means includes a plurality of rollers spaced forwardly from said bar and being rotatable about a vertical axis.

3. The device of claim 2 wherein said restraining means further includes a support bracket for each of said rollers, said support bracket having a first portion secured to said bar, a second portion extending forwardly from said bar beneath and beyond the lower edge of said door, and an axle extending upwardly from the forward end of said second portion for rotatably supporting said roller.

4. The device of claim 3 wherein said second portion of said support bracket includes an elongated slot extending forwardly and rearwardly, and through which said axle extends, for allowing adjustment of the position of said axle, and thereby the associated roller, with respect to said bar such that the width of said channel is adjustable so as to accommodate doors having varying thicknesses.

5. The device of claim 1 wherein said securement means includes quick-release means for lockingly securing the ends of the bar to the sides of the door opening and for quickly releasing the ends of the bar from the sides of the door opening such that said bar can be quickly removed from the door opening whereby an object can be moved through the door opening without obstruction by said bar.

6. The device of claim 5 wherein said securement means further includes a pair of end brackets, each end bracket being secured to one side of said door opening and each end bracket including a pair of spaced apart legs and a web interconnecting said legs so as to form a U-shaped collar having an open end adapted to receive the respective end of said bar.

7. The device of claim 6 wherein each of said legs of said securement brackets has a hole, and said quick-release means includes a removable pin adapted to extend through said holes in said legs of each securement bracket so as to lock said bar in position within said U-shaped channel.

8. In combination with a building having a floor, a door frame defining a door opening with opposite sides, and a slidable door having upper and lower edges and opposite front and back sides, said door being supported at its upper edge for lateral movement between open and closed positions with respect to the door frame, a device for preventing forward and backward movement of the closed door with respect to the door frame, comprising:

elongated channel means completely spanning said door frame and said door frame opening above and adjacent to said floor and having opposite ends; said channel means includes an elongated bar having opposite ends, at least one roller horizontally spaced apart from said bar so as to define a gap between said bar and said roller, and bracket means for connecting said roller to said bar in a spaced apart relation and for supporting said roller for rotation about a vertical axis; and securement means for releasably securing said opposite ends of said elongated bar to respective sides of said door frame;

said lower edge of said door being received in said gap when said door is in said closed position whereby forward and backward movement of said door is prevented.

9. The device of claim 8 wherein said bracket means includes a first portion secured to said bar, a second portion extending away from said bar beneath and beyond the lower edge of said door, and an axle extending upwardly from said second portion for rotatably supporting said roller.

10. The device of claim 9 wherein said second portion of said bracket means includes an elongated slot extending forwardly and rearwardly and through which said axle extends for allowing adjustment of the position of said axle, and thereby the associated roller, with respect to said bar such that the width of said gap is adjustable so as to accommodate doors having varying thicknesses.

11. The device of claim 8 wherein said securement means includes quick-release means for lockingly securing the ends of the bar to the sides of the door frame and for quickly releasing the ends of the bar from the sides of the door frame such that said bar can be quickly removed from the door frame whereby an object can be moved through the door frame without obstruction by said bar.

12. The device of claim 11 wherein said securement means further includes a pair of end brackets, each end bracket being secured to one side of said door opening and each end bracket including a pair of spaced apart legs and a web interconnecting said legs so as to form a U-shaped collar having an open end adapted to receive the respective end of said bar.

13. The device of claim 12 wherein each of said legs of said end brackets has a hole, and said quick-release means includes a removable pin adapted to extend through said holes in said legs of each securement bracket so as to lock said bar in position within said U-shaped channel.

* * * * *